United States Patent [19]

Fushiya et al.

[11] Patent Number: 4,762,035

[45] Date of Patent: Aug. 9, 1988

[54] DEPTH ADJUSTING DEVICE FOR SCREWDRIVERS

[75] Inventors: Fusao Fushiya; Tetsuhisa Kaneko, both of Anjo, Japan

[73] Assignee: Makita Electric Works, Ltd., Anjo, Japan

[21] Appl. No.: 92,547

[22] Filed: Sep. 3, 1987

[30] Foreign Application Priority Data

Sep. 16, 1986 [JP] Japan ..... 61-142062[U]

[51] Int. Cl.[4] ..... B25B 23/00

[52] U.S. Cl. ..... 81/429; 81/54

[58] Field of Search ..... 81/429, 54, 57, 57.11, 81/57.14, 57.3

[56] References Cited

U.S. PATENT DOCUMENTS 2,940,488 6/1960 Riley ..... 81/429
3,460,408 8/1969 Raymond ..... 81/429
3,527,273 9/1970 Falter ..... 81/429
3,712,352 1/1973 Lafferty ..... 81/429

*Primary Examiner*—Frederick R. Schmidt
*Assistant Examiner*—Bradley I. Vaught
*Attorney, Agent, or Firm*—Dennison, Meserole, Pollack & Scheiner

[57] ABSTRACT

A depth adjusting device for a screwdriver which is adapted to control within predetermined desired limits the depth to which a fastener may be driven into a work. The depth adjusting device comprises a locking ring retentively engaging the tool housing, and an adjusting sleeve axially movably carried by the locking ring. The locking ring has a spiral ridge formed on the inner periphery thereof, and the adjusting sleeve has a spiral groove formed peripherally about the rear portion thereof and engageable with the spiral ridge of the locking ring. The locking ring also has an axial slit formed therein and a pair of lugs formed across the slit. A thumb screw is provided to tighten the lugs and thence to retain the locking ring on the adjusting sleeve.

6 Claims, 3 Drawing Sheets

DEPTH ADJUSTING DEVICE FOR SCREWDRIVERS

BACKGROUND OF THE INVENTION

1. Field of the Invention

The present invention relates to an improvement in a depth adjusting device for screwdrivers, and more particularly to such a depth adjusting device for setting self drilling fasteners, self tapping fasteners, drywall fasteners and the like at a specific distance relative to a given work surface of relatively soft board such as gypsum board and asbestos board.

2. Description of the Prior Art

Such a depth adjusting device is disclosed, for example, in U.S. Pat. Nos. 3,527,273 and 3,712, 352. The disclosed device includes a locking collar threaded onto the forward end of the tool housing, a locator sleeve carried by the locking collar, and a compression spring acting between the locking collar and the locator sleeve to axially move the locator sleeve. When adjusting the axial position of the locator sleeve, the operator must rotate the locking collar against the biasing action of the compression spring, to also rotate the locator sleeve in order to vary the distance between the work contacting end of the locator sleeve and the end of a screwdriver bit tip. This rotating operation of the locator sleeve tends to require a due force and time. Especially, when a substantial depth adjustment is made or when the bit is removed for exchange, the rotating operation of the locking collar and the locator sleeve is cumbersome, and the assembling procedure of the device is troublesome. Further, the disclosed device has an increased number of components and is complicated in construction.

SUMMARY OF THE INVENTION

It is, accordingly, an object of the present invention to provide a depth adjusting device for screwdrivers which may reliably and easily control the depth to which a fastener may be driven into a work.

It is another object of the present invention to provide a depth adjusting device which is simple in construction, easy to assembly and inexpensive to manufacture.

According to the present invention, there is provided a depth adjusting device for a screwdriver which is adapted to control within predetermined desired limits the depth to which a fastener may be driven into a work. The depth adjusting device comprises a locking ring retentively engaging the forward end of the tool housing, an adjusting sleeve carried by the locking ring, means for axially moving the adjusting sleeve with respect to the locking ring, and means on the locking ring for releasably locking the axial movement of the adjusting sleeve with respect to the locking ring.

The present invention will become more fully apparent from the claim and the description as it proceeds in connection with the drawings.

DETAILED DESCRIPTION OF THE PREFERRED EMBODIMENT

Figure 1:
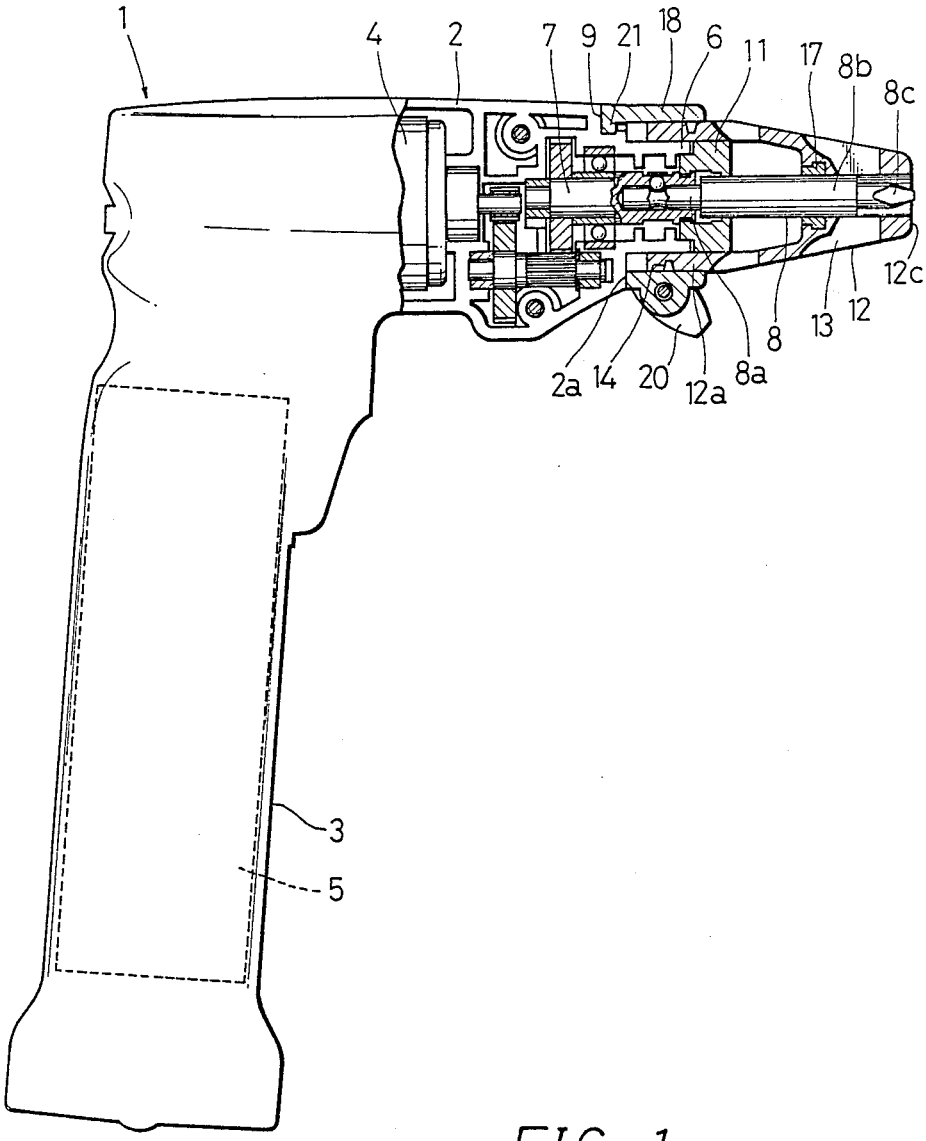
FIG. 1 is a side view, partly in cross section, of a screwdriver having a depth adjusting device constructed in accordance with the present invention.

Referring now more specifically to the drawings, a screwdriver, embodying the present invention, is shown generally at 1 in FIG. 1, and is seen to include a housing 2 and a dependent, grip handle 3 integral therewith. The housing 2 contains an electric motor 4 connected to a gear reduction drive, and the grip handle 3 contains a battery pack 5 which supplies electric power to the motor 4.

The housing 2 has a stepped portion **2*a* formed on the forward end thereof and a reduced-diameter mounting boss 6 extending forwardly from the stepped portion 2a. A spindle 7 is rotatably supported within the housing 2 and extends through the mounting boss 6. The forward end of the spindle 7 is socketed and is adapted to receive a shank 8*a* at one end of a tool bit 8, so that upon rotation of the motor 4, the spindle 7 and the tool bit 8 rotate conjointly. The tool bit 8 is retained within the spindle 7 with its body 8*b* and tip 8*c* extending forwardly of the mounting boss 6**.

Figure 2:
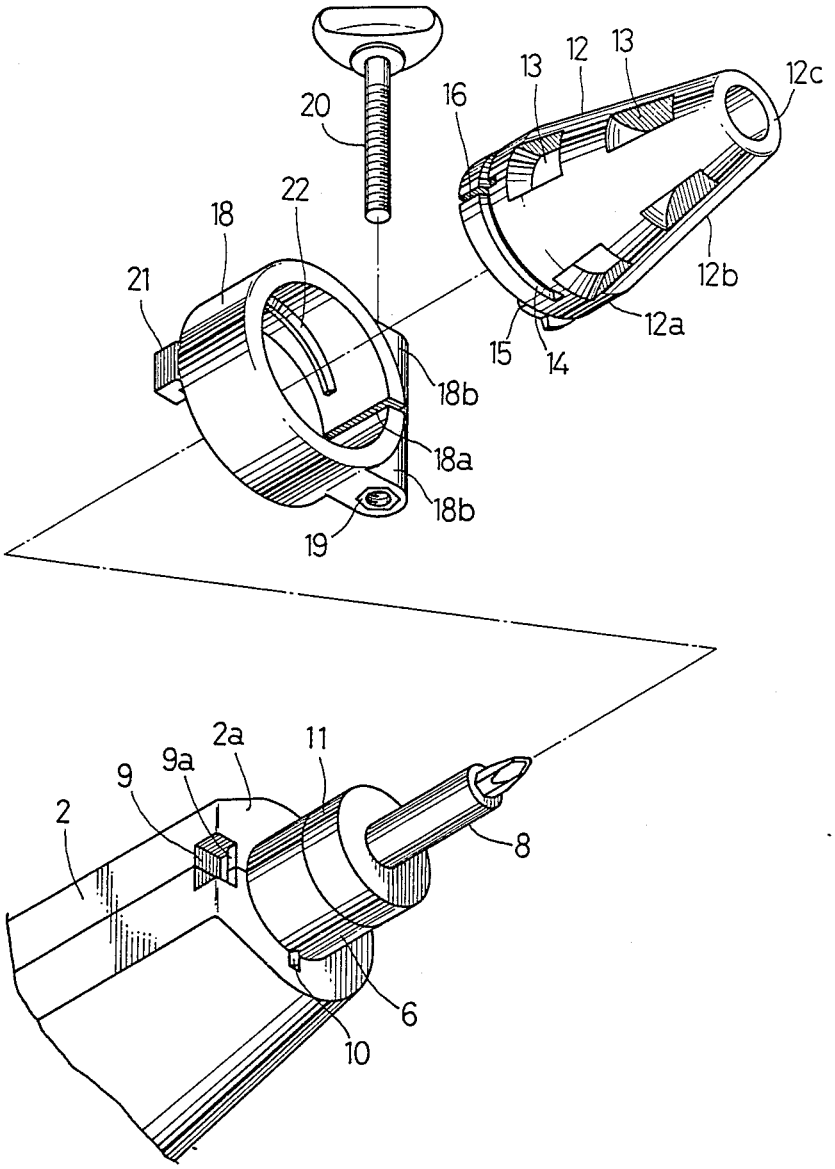
FIG. 2 is an exploded perspective view of the essential parts of the screwdriver.

As shown in FIG. 2, the housing 2 also includes, in the upper end of the stepped portion **2*a*, a rectangular engaging recess 9 having a projecting edge 9*a* at its forward end. The mounting boss 6 has a trigonal stopper 10 formed adjacent the stepped portion 2*a*. A spacer ring 11 is fixedly connected to the mounting boss 6 and is adapted to seal the spindle 7** against dust and other foreign matter.

Figure 3:
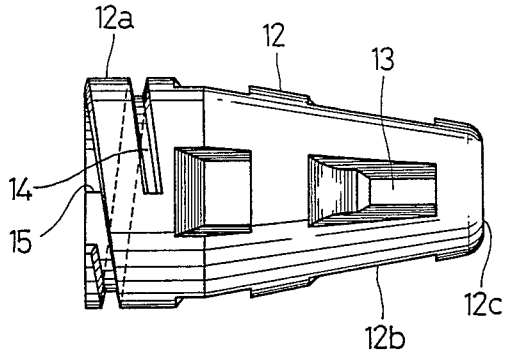
FIG. 3 is a side view of the adjusting sleeve.

An adjusting sleeve 12 of a tough molded plastic material is provided for depth adjustment and is releasably secured to the mounting boss 6, with the tool bit 8 positioned therein. Specifically, as shown in FIGS. 2 and 3, the adjusting sleeve 12 has a base portion **12*a*, a frusto-conical nose 12*b* and a work contacting end 12*c*. The adjusting sleeve 12 also has a suitable number of openings 13 formed in the nose 12*b*, a spiral groove 14 formed in and extending fully about the outer periphery of the base portion 12*a*, and an abutting edge 15 formed on the rear end thereof. The abutting edge 15 is adapted to abut against the stopper 10 of the housing 2 and thence to limit rotational movement of the adjusting sleeve 12. A slit 16 is formed adjacent the rear end of the base portion 12*a*. As shown in FIG. 1, a bearing member 17 is retained within the adjusting sleeve 12 for rotatably supporting the tool bit body 8*b***.

Figure 4:
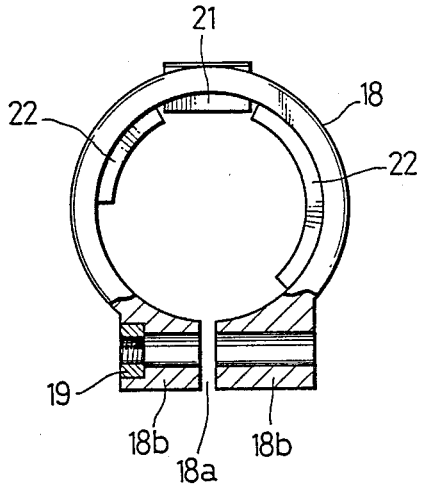
FIG. 4 is a front view, partly in cross section, of the locking ring.

A locking ring 18 of the same material as the adjusting sleeve 12 is provided to releasably secure the adjusting sleeve 12 to the mounting boss 6 and is mounted over the forward portion of the housing 2 and the base portion **12*a* of the adjusting sleeve 12. Specifically, as shown in FIGS. 2 and 4, the locking ring 18 has on the lower end thereof an axial slit 18*a* formed to expand or contract the inside diameter thereof, and a pair of lugs 18*b* formed integrally therewith across the slit 18*a*, each having a bore therethrough. A nut 19 is fitted in one of the lugs 18*b* and is adapted to threadably engage a thumb screw 20 carried by the lugs 18*b***.

The locking ring 18 also has a retaining hook 21 projecting from the rear end thereof. The retaining hook 21 is received in the engaging recess 9 of the housing 2 for retaining the upper end of the locking ring 18 on the forward end of the housing 2 and for preventing rotation and withdrawal of the locking ring 18. Further, as best shown in FIG. 4, the locking ring 18 is provided on the inner periphery thereof with spiral ridges 22 which are engageable with the spiral groove 14 in the adjusting sleeve 12 for moving the adjusting sleeve 12 axially of the tool bit 8. Thus, when the adjusting sleeve 12 is rotated, the adjusting sleeve 12 is moved axially of the tool bit 8, varying the distance between the work contacting end 12*c* of the adjusting sleeve 12 and the end of the tool bit tip 8*c* and thus adjusting the depth to which a fastener will be seated by the tool bit 8.

The thumb screw 20 is shaped as shown in FIG. 2 and is inserted in the lugs 18*b* of the locking ring 18, with its tip engaged by the nut 19. The task of the thumb screw 20 is to releasably tighten the locking ring 18 so that the adjusting sleeve 12 is releasably retained on the mounting boss 6. Thus, when the thumb screw 20 is tightened, the lugs 18*b* are moved toward one another to thereby reduce the inside diameter of the locking ring 18, retaining the latter on the mounting boss 6 of the housing 2 through the adjusting sleeve 12. Conversely, when the thumb screw 20 is loosened, the distance between the lugs 18*b* is resiliently expanded to thereby release the base portion 12*a* of the adjusting sleeve 12 from its tightened position, permitting the adjusting sleeve 12 to be rotated for a desired depth adjustment. After the desired depth adjustment has been made, the thumb screw 20 is turned to tighten the locking ring 18 onto the adjusting sleeve 12.

An important feature of the present invention resides in the specific arrangement of the adjusting sleeve 12, the locking ring 18 and the thumb screw 20. Assuming that a tool bit 8 has been mounted on the tool 1, the adjusting sleeve 12 is inserted between the locking ring 18 and the mounting boss 6 and is then turned for a desired depth adjustment. After the desired depth adjustment has been made, the thumb screw 20 is turned to tighten the locking ring 18 onto the adjusting sleeve 12. Thus, it will be appreciated that the adjusting sleeve 12 may be easily and reliably locked on the mounting boss 6. This insures that the depth adjusting operation is simply accomplished and that the adjusting mechanism is simple in construction and is easily assembled and disassembled.

Another feature of the invention resides in the abutting edge 15 formed on the adjusting sleeve 12 and engageable with the stopper 10 of the housing 2. Thus, there is no tendency for the adjusting sleeve 12 to be rotated excessively, which would otherwise draw the retaining hook 21 of the locking ring 18 forwardly and damage it.

While the invention has been described with reference to a preferred embodiment thereof, it is to be understood that modifications or variations may be easily made without departing from the scope of the present invention which is defined by the appended claims.

What is claimed is:

1. In a screwdriver having a suitable housing, a depth adjusting device adapted to control within predetermined desired limits the depth to which a fastener may be driven into a work, comprising:

a diametrically contractible locking ring retentively engaging the forward end of said housing:

an adjusting sleeve received within and carried by said locking ring;

means for axially moving said adjusting sleeve with respect to said locking ring; and means on said locking ring for diametrically contracting the locking ring and releasably locking the axial movement of said adjusting sleeve with respect to said locking ring.

2. The depth adjusting device as defined in claim 1 wherein said housing includes an engaging recess formed in the forward end thereof, and wherein said locking ring includes a retaining hook extending from the rear end thereof and retentively engaging said engaging recess of said housing.

3. The depth adjusting device as defined in claim 1 wherein said means for axially moving said adjusting sleeve comprises a spiral ridge formed on the inner periphery of said locking ring and a spiral groove formed peripherally about the rear portion of said adjusting sleeve and engageable with said spiral ridge of said locking ring.

4. The depth adjusting device as defined in claim 1 wherein said means for diametrically contracting the locking ring and releasably locking the axial movement of said adjusting sleeve comprises an axial slit formed in a portion of said locking ring, a pair of lugs formed across said slit and each having a bore therethrough, a nut fitted in one of said pair of lugs, and a thumb screw inserted in said pair of lugs and engageable with said nut for tightening said pair of lugs.

5. The depth adjusting device as defined in claim 1 wherein said means for diametrically contracting the locking ring and releasably locking the axial movement of said adjusting sleeve comprises an axial slit formed in a portion of said locking ring, nut means on said locking ring to the opposite sides of said slit, and screw means engageable between said nut means.

6. The depth adjusting device of claim 5 including means for retaining said locking ring against the forward end of the housing and for preventing rotation and withdrawal of the locking ring, said means for retaining said locking ring comprising a recess formed in the forward end of the housing, said recess including lateral sides and a forward projecting edge, a retaining hook on said locking ring extending into said recess between the lateral sides and inward of the projecting edge, said hook including a depending portion engaging inward of said projecting edge, whereby said lateral sides prevent rotation of the hook and ring, and said projecting edge prevents withdrawal of said hook and ring.

* * * * *